US011472581B2

(12) United States Patent
Cere'

(10) Patent No.: US 11,472,581 B2
(45) Date of Patent: Oct. 18, 2022

(54) WRAPPING MACHINE

(71) Applicant: AETNA GROUP S.P.A., Verucchio (IT)

(72) Inventor: Mauro Cere', Verucchio (IT)

(73) Assignee: AETNA GROUP S.P.A., Verucchio (IT)

( * ) Notice: Subject to any disclaimer, the term of this patent is extended or adjusted under 35 U.S.C. 154(b) by 132 days.

(21) Appl. No.: 16/965,152

(22) PCT Filed: Feb. 13, 2019

(86) PCT No.: PCT/IB2019/051161
§ 371 (c)(1),
(2) Date: Jul. 27, 2020

(87) PCT Pub. No.: WO2019/159076
PCT Pub. Date: Aug. 22, 2019

(65) Prior Publication Data

US 2021/0047060 A1 Feb. 18, 2021

(30) Foreign Application Priority Data

Feb. 14, 2018 (IT) ..... 102018000002669

(51) Int. Cl.
*B65B 11/02* (2006.01)
*B65B 11/58* (2006.01)

(52) U.S. Cl.
CPC ..... *B65B 11/025* (2013.01); *B65B 11/585* (2013.01); *B65B 2210/18* (2013.01)

(58) Field of Classification Search
None
See application file for complete search history.

(56) References Cited

U.S. PATENT DOCUMENTS 3,667,598 A * 6/1972 Zelnick ..... B65B 11/585 53/442
4,296,595 A * 10/1981 Meiners ..... A01F 15/071 53/118

(Continued)

FOREIGN PATENT DOCUMENTS

| | | |
|---|---|---|
| DE | 3541736 | 5/1987 |
| EP | 0 336 517 | 10/1989 |
| EP | 1 818 262 | 8/2007 |

OTHER PUBLICATIONS

International Search Report dated Apr. 15, 2019 in International (PCT) Application No. PCT/IB2019/051161.

*Primary Examiner* — Hemant Desai
*Assistant Examiner* — Tanzim Imam
(74) *Attorney, Agent, or Firm* — Wenderoth, Lind & Ponack, L.L.P.

(57) ABSTRACT

A wrapping machine includes a frame for supporting a wrapping unit arranged to wrap a load with a film of plastic material, and a covering apparatus arranged to supply a covering sheet to be positioned on top of the load. The covering apparatus includes a reel of covering sheet and gripping assembly movable along an unwinding direction and arranged to grasp and unwind from the reel and place above the load the covering sheet. The covering apparatus includes a supporting structure connected to an upper portion of the frame and slidably supporting the gripping assembly, and a supplying unit supporting a respective reel of covering sheet and reversibly coupled to the supporting structure so as to be removable and replaceable with another supplying unit, in particular in case of depletion of the reel of covering sheet.

13 Claims, 9 Drawing Sheets

(56) References Cited

U.S. PATENT DOCUMENTS

| | | | | |
|---|---|---|---|---|
| 4,936,080 | A * | 6/1990 | Haloila | B65B 11/025 53/465 |
| 5,048,261 | A * | 9/1991 | Lancaster, III | B65B 11/045 53/399 |
| 5,819,503 | A * | 10/1998 | Lancaster, III | B65B 11/585 53/399 |
| 6,494,400 | B1 | 12/2002 | Zitella et al. | |
| 6,584,752 | B1 * | 7/2003 | Herava | B65B 11/585 53/399 |
| 6,945,018 | B2 | 9/2005 | Suolahti | |
| 7,430,959 | B2 * | 10/2008 | Routledge | A01F 15/08 100/88 |
| 7,784,252 | B2 * | 8/2010 | Cere' | B65B 41/14 53/461 |
| 7,854,105 | B2 | 12/2010 | Zitella et al. | |
| 2004/0226266 | A1 * | 11/2004 | Suolahti | B65B 11/025 53/428 |
| 2004/0226271 | A1 * | 11/2004 | Suolahti | B65B 11/025 53/588 |
| 2007/0189762 | A1 | 8/2007 | Cere | |
| 2008/0202071 | A1 * | 8/2008 | Suolahti | B65B 11/045 53/580 |
| 2008/0229714 | A1 | 9/2008 | Zitella et al. | |
| 2010/0000184 | A1 | 1/2010 | Zitella et al. | |
| 2013/0255186 | A1 * | 10/2013 | Magri | B65B 13/12 53/218 |
| 2014/0217258 | A1 * | 8/2014 | Cere' | B65B 11/025 104/118 |

* cited by examiner

WRAPPING MACHINE

The invention relates to machines for wrapping a load or a group of products with a cold-stretchable plastic material film or wrap. In particular, the invention refers to a wrapping machine configured to position a covering sheet on the top of a load and subsequently wrap the latter and the covering sheet with a stretchable plastic material film.

In the packaging of products, typically groups of products arranged on a pallet for forming a so-called palletized load, it is known the use of a covering sheet, made of plastic material, placed on the top of the load and subsequently fixed to the latter by means of binding with a film in order to protect products from bad weather, for example rain, snow, humidity or from dust.

The covering sheet can be applied directly inside wrapping machines by means of internal covering apparatuses, referred to as "top inside" systems, or outside wrapping machines, by means of proper independent covering apparatuses, referred to as "top outside" systems. They are known horizontal rotating ring wrapping machines provided with covering apparatuses arranged to supply a covering sheet and lay it on the load. The latter remains fixed during wrapping, while a film wrapping unit fixed to the rotating ring is moved with respect to the latter rotating around, and in translation along, a vertical wrapping axis such as to wrap it forming a series of film strips or bands intersected and partially overlapped with a helix trend.

Covering apparatuses comprise a supporting frame to which a gripping crossbeam is slidably connected, movable and able to unwind the covering sheet from a reel and lay it over the load. The film reel is rotatably mounted on the supporting frame and the movable crossbeam is provided with gripping pliers configured for grasping an initial flap of the covering sheet and it is linearly moved by proper driving means. Cutting means are fixed to the supporting frame and are arranged to cut a portion of the covering sheet having definite length; the cut portion falls by gravity onto the underlying load.

The supporting frame of the covering apparatus is fixed to an upper portion of the support structure of the wrapping machine, such that it results to be above both a maximum height reachable by the load and the space occupied by the rotating ring bearing the film wrapping unit.

Alternatively, the frame of the covering apparatus can be fixed to the movable structure which rotatably supports the rotating ring and which is vertically movable, parallelly to the rotation axis of the rotating ring.

The covering apparatus can be mounted on the wrapping machine with a longitudinal arrangement in which the film reel (i.e. the rotation longitudinal axis thereof) is parallel to an advancing direction of the load through the wrapping machine or with a transverse arrangement, in which the film reel is orthogonal to the advancing direction.

By the first longitudinal arrangement it is easier to replace the film reel, as the latter can be accessed through a free side of the wrapping machine not occupied by load moving means, typically consisting in a plurality of roller conveyors or aligned transporting means, which allow to move the load inside and outside the machine along the advancing direction. However such a longitudinal arrangement has the disadvantage that it only allows efficient and optimal wrapping for loads or products having an established length. Standard palletized loads in fact have a prefixed width (800 mm or 1000 mm for European pallets) and a length that can instead vary (400 mm to 1200 mm). As they are moved through the machine arranged with a front side having prefixed width, a reel of covering sheet must be mounted on the covering apparatus having length suitable for the length of the palletized load. If the reel length, i.e. the width of the covering sheet, is lower than the length of the palletized load, the latter cannot be suitably covered, while if the reel length is exceeding, there is a waste of covering sheet. With such an arrangement the covering sheet is cut into portions substantially having the same length related to the width (which generally does not change) of the palletized load.

Such a disadvantage is overcome by the second transverse arrangement of the covering apparatus wherein the length of the film reel, i.e. the width of the covering sheet, is related to the width of the palletized load (which generally does not change), while the portions of the covering film are cut with a length corresponding to the length of the palletized load to be covered. Thereby the covering sheet is used optimally with no waste.

Such a transverse arrangement of the covering apparatus of the covering sheet has the disadvantage that it requires a procedure for replacing the film reel which is much more complex and time consuming as the latter is partially and limitedly accessible from the free side of the wrapping machine not occupied by moving means.

With both arrangements of the covering apparatus, the procedure for replacing the reel is however complex, laborious and time-consuming requiring an operator to go up to the top of the wrapping machine, dismount and place the depleted reel on the floor, and lift up and assemble a new reel. Such a procedure also requires proper means to allow the operator to go on the machine and reach the covering apparatus and means, such as an elevator or hoist fixed to the wrapping machine thereof, for lowering and lifting the reel.

The procedure for prearranging an initial flap of sheet unwound from the reel to be grasped by pliers of the gripping crossbeam is equally complex and laborious as it has to be carried out by the operator at the top of the wrapping machine.

As the operator works at several-meter-height from the floor, the whole replacement procedure of the reel is not free from hazards for the safety of the operator himself. Document EP 1818262 discloses a positioning unit adapted to position a covering sheet for covering the top of a group of products. The positioning unit comprises a second film roll and a first carriage slidably mounted on guides along an upper horizontal plane and driven in both directions along the wrapping area by means of motorized moving means. The first carriage is provided by a first gripping unit designed to grasp the free end of the film and unwind the latter according to a predefined length. Film cutting means are arranged near the second roll and designed to separate from the rest of the film the predetermined length of unwound film. One second carriage is slidably mounted on the guide near cutting means and a second gripping unit is mounted on the second carriage, acting on the film such as to retain the sheet in a second gripping point when the cutting means are activated. Coupling means are adapted to couple the second carriage to the motorized moving means such that, when engaged, the two carriages can move together as if they were one to position the sheet centrally on the upper surface of the group of products.

An object of the invention is to improve known wrapping machines provided with covering apparatuses arranged to supply a covering sheet and lay it on the top of a load to be subsequently wrapped with a plastic film.

Another object is to provide a wrapping machine provided with a load covering apparatus with a covering sheet allowing an operator to replace the reels of the covering sheet rapidly, easily and securely, reducing significantly the stopping time of the wrapping machine and the risks for the operator safety.

A further object is to implement a wrapping machine which allows an operator to prearrange rapidly, easily and securely a new reel of covering sheet for subsequent production.

Another further object is to implement a wrapping machine which allows to arrange the reel of covering sheet parallelly or orthogonally to a load advancing direction, according to specific needs.

These and other objects are achieved by a wrapping machine according to one of the following claims.

The invention shall be better understood and implemented referring to the enclosed drawings illustrating some exemplary and not-limiting embodiments thereof, wherein.

Figure 2:
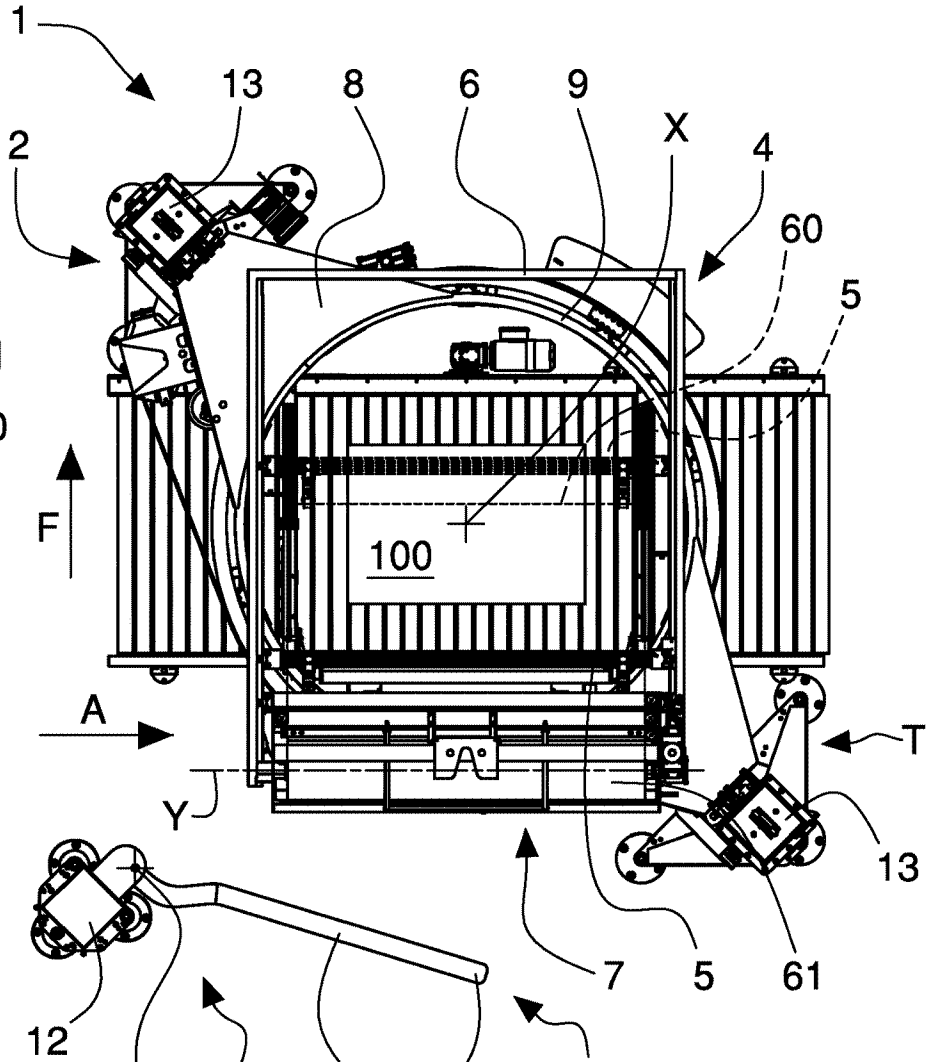
FIG. 2 is a plan view of the wrapping machine of FIG. 1 wherein some parts are removed in order to better illustrate the covering apparatus.
Figure 1:
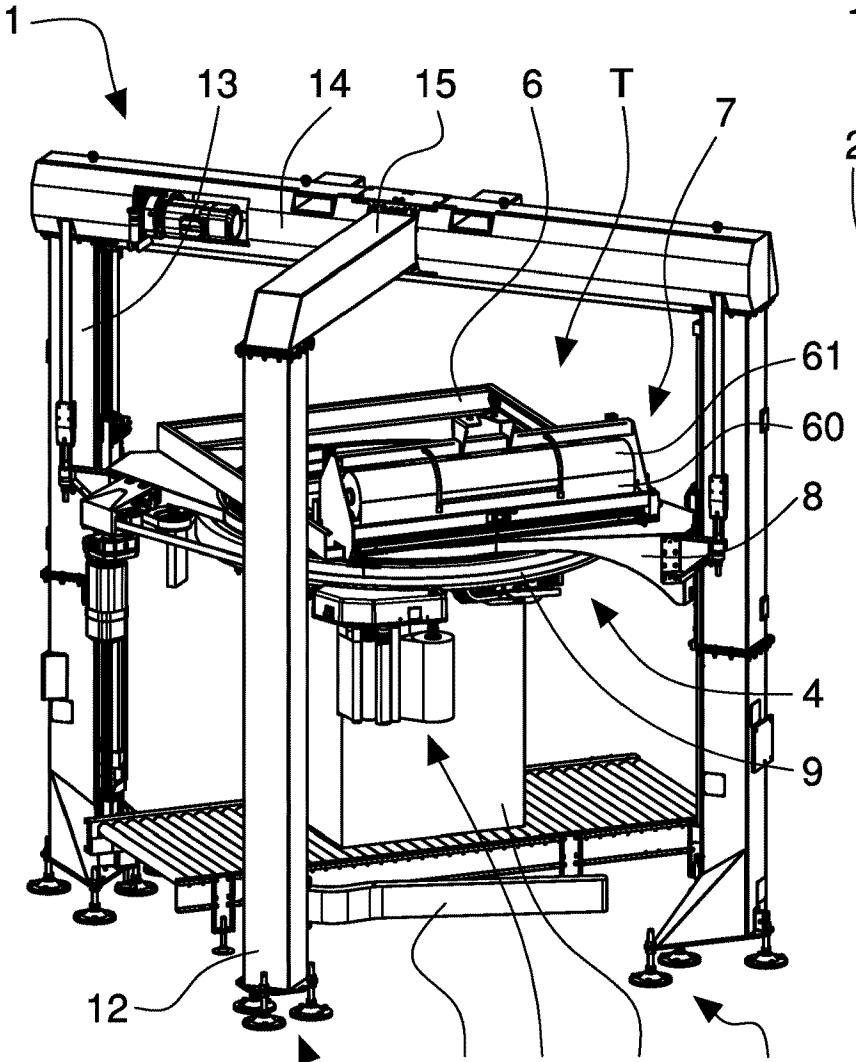
FIG. 1 is a perspective view of the wrapping machine of the invention associated to a load to be wrapped and provided with a covering apparatus of the load with a covering sheet mounted on frame means of the machine in a first operating position.
Figure 3:
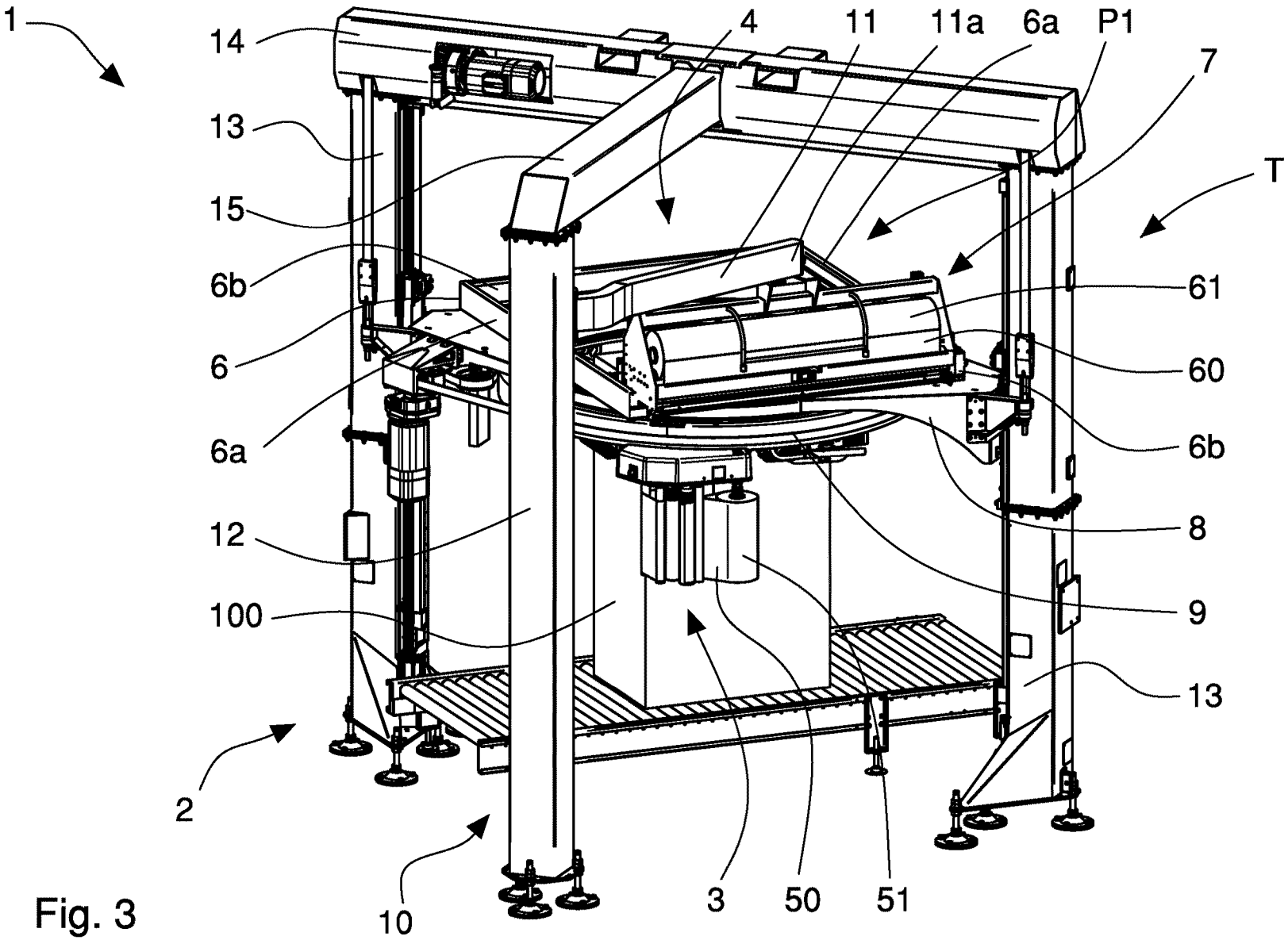
FIG. 3 is an enlarged perspective view of the wrapping machine of FIG. 1 in a step of a procedure for replacing a reel of covering sheet.
Figure 4:
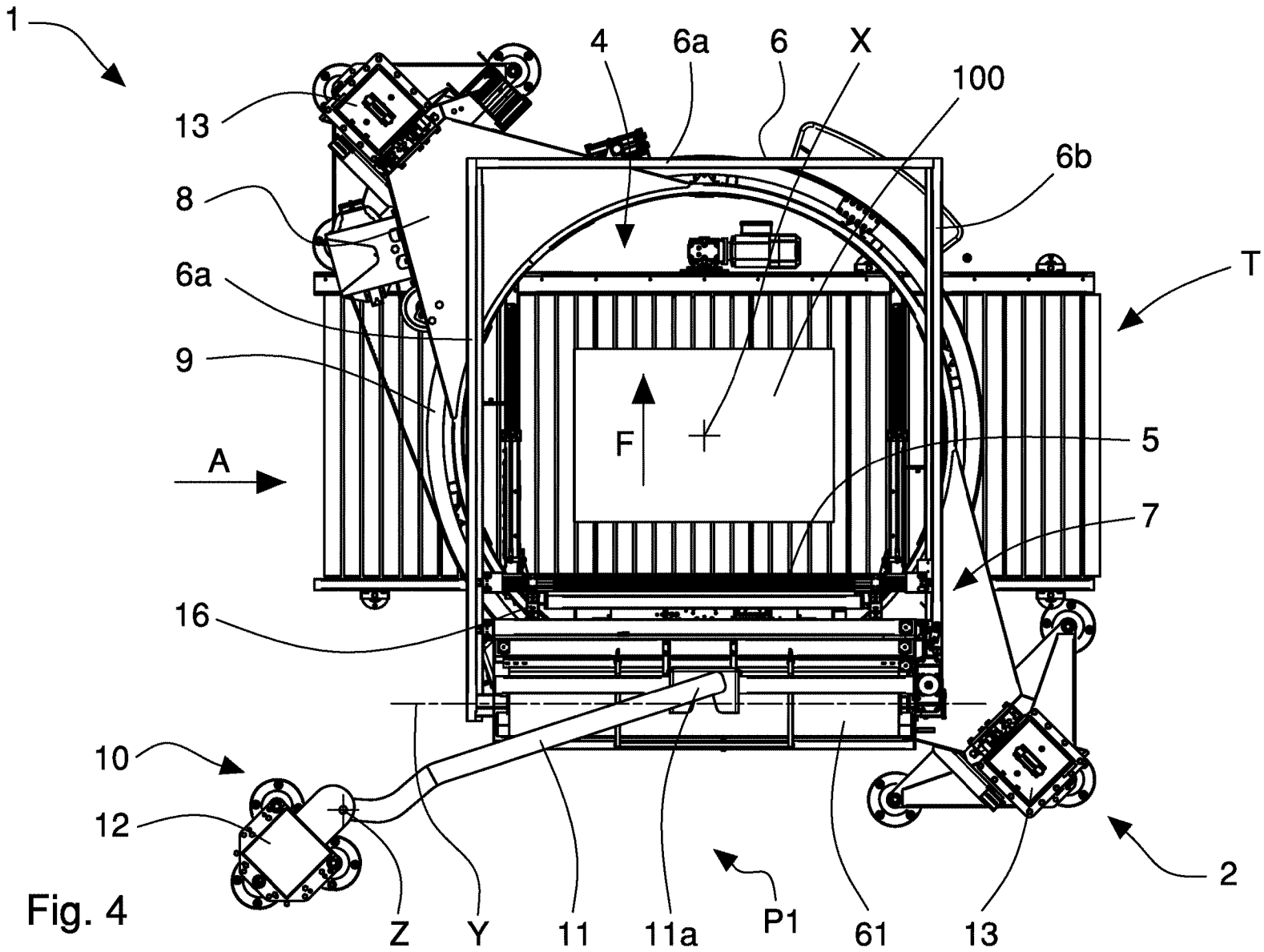
FIG. 4 is a plan view of the wrapping machine of FIG. 3 wherein some parts are removed in order to better illustrate the covering apparatus.
Figure 5:
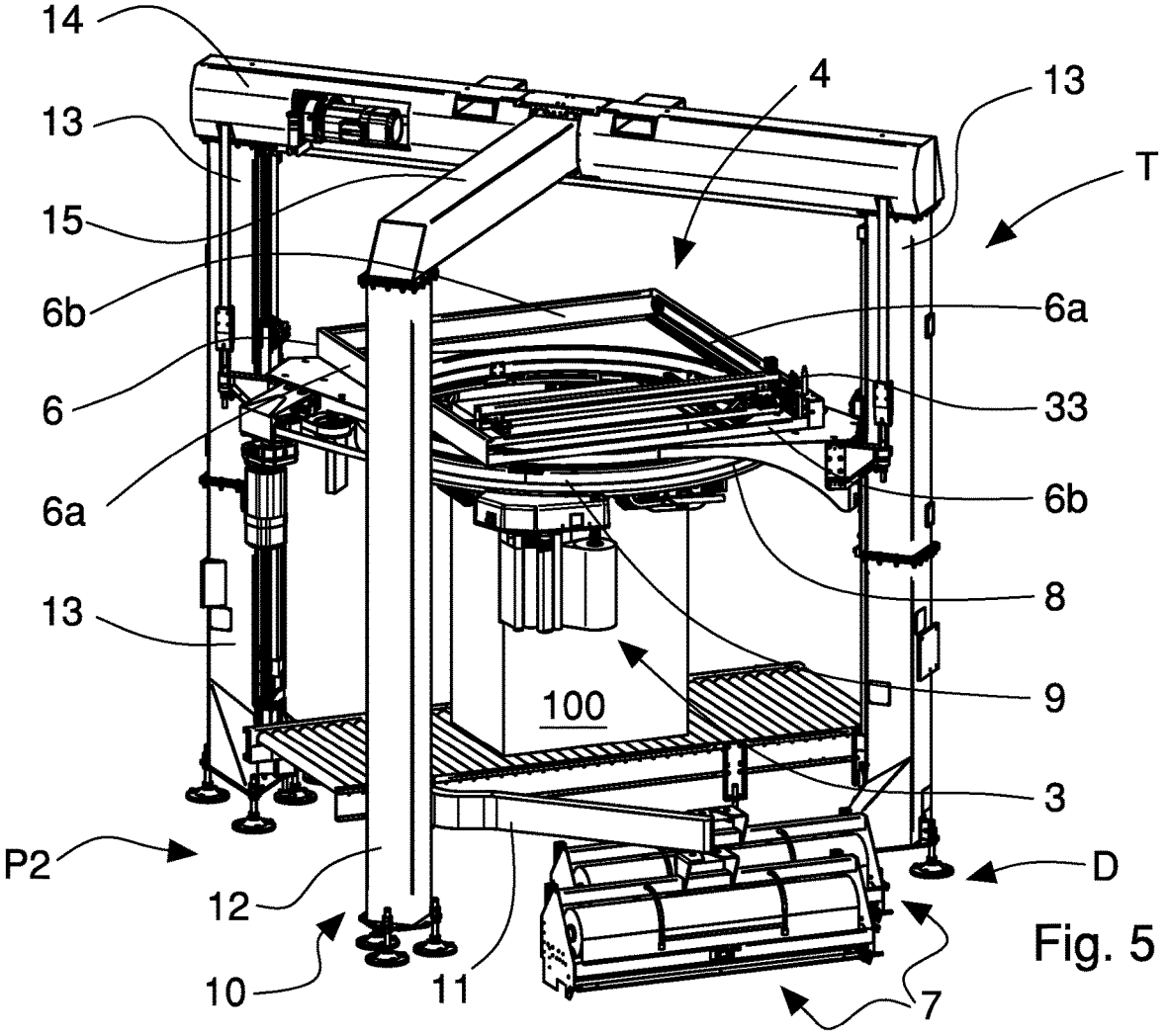
FIG. 5 is a perspective view of the wrapping machine of FIG. 3 in a further step of the procedure for replacing a reel of covering sheet.

Referring to FIGS. 1 to 9, the wrapping machine 1 of the invention is shown comprising frame means 2, 8 for supporting a wrapping unit 3 arranged to wrap a load 100 with a stretchable plastic material film 50 and a covering apparatus 4 arranged to supply a covering sheet 60, in plastic material as well, and position it on top of the load 100 such as to realize, in cooperation with the film 50, a bending or wrapping of the "water-proof" type, that is a bending securing an efficient protection of the load from bad weather, for example rain, snow, humidity and from dust. The load 100 is for example a palletized load i.e. composed of a group of products arranged on a pallet.

The wrapping unit 3, of the known type, includes a reel 61 of stretchable plastic film 50, a couple of pre-stretching rollers adapted to unwind the film 50 from the reel and stretch and elongate it for a predefined quantity and a plurality of return rollers.

The covering apparatus 4 comprises a reel 61 of covering sheet 60 and gripping means 5 movable along an unwinding direction F and arranged to grasp and unwind from the reel 61 the covering sheet 60 such as to arrange it above the load 100. More precisely, the covering apparatus 4 includes a supporting structure 6, which is connected to an upper portion of the frame means 2, 8 and which slidably supports the gripping means 5, and a supplying unit 7 which supports a respective reel 61 of covering sheet 60 and is reversibly coupled to the supporting structure 6 so that it is removable and replaceable with another supplying unit 7, in particular in case of depletion of the reel 61.

As illustrated in FIGS. 1 to 6, the supporting structure 6 of the covering apparatus 4 can be fixed to the upper portion of the frame means 2, 8 in a first operating position T, in which the unwinding direction F of the covering sheet 60 is transverse, in particular substantially orthogonal, to an advancing direction A of the load 100 through the wrapping machine 1, i.e. in which a rotation longitudinal axis Y of the reel 61 of the covering sheet 60 results to be almost parallel to the advancing direction A.

Figure 7:
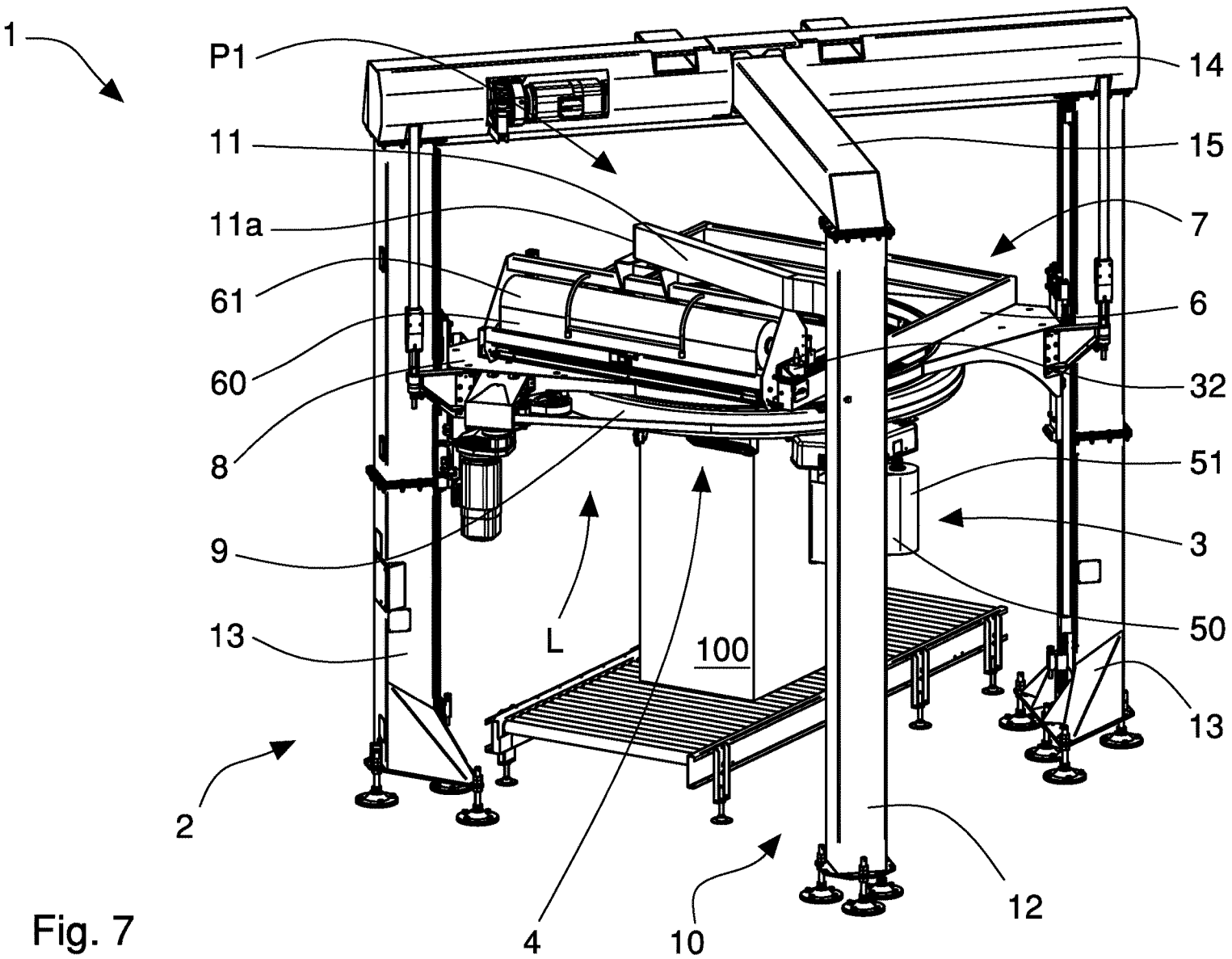
FIG. 7 is a perspective view of the wrapping machine of the invention with the covering apparatus arranged in a second operating position and in a step of the procedure for replacing the reel of covering sheet.
Figure 8:
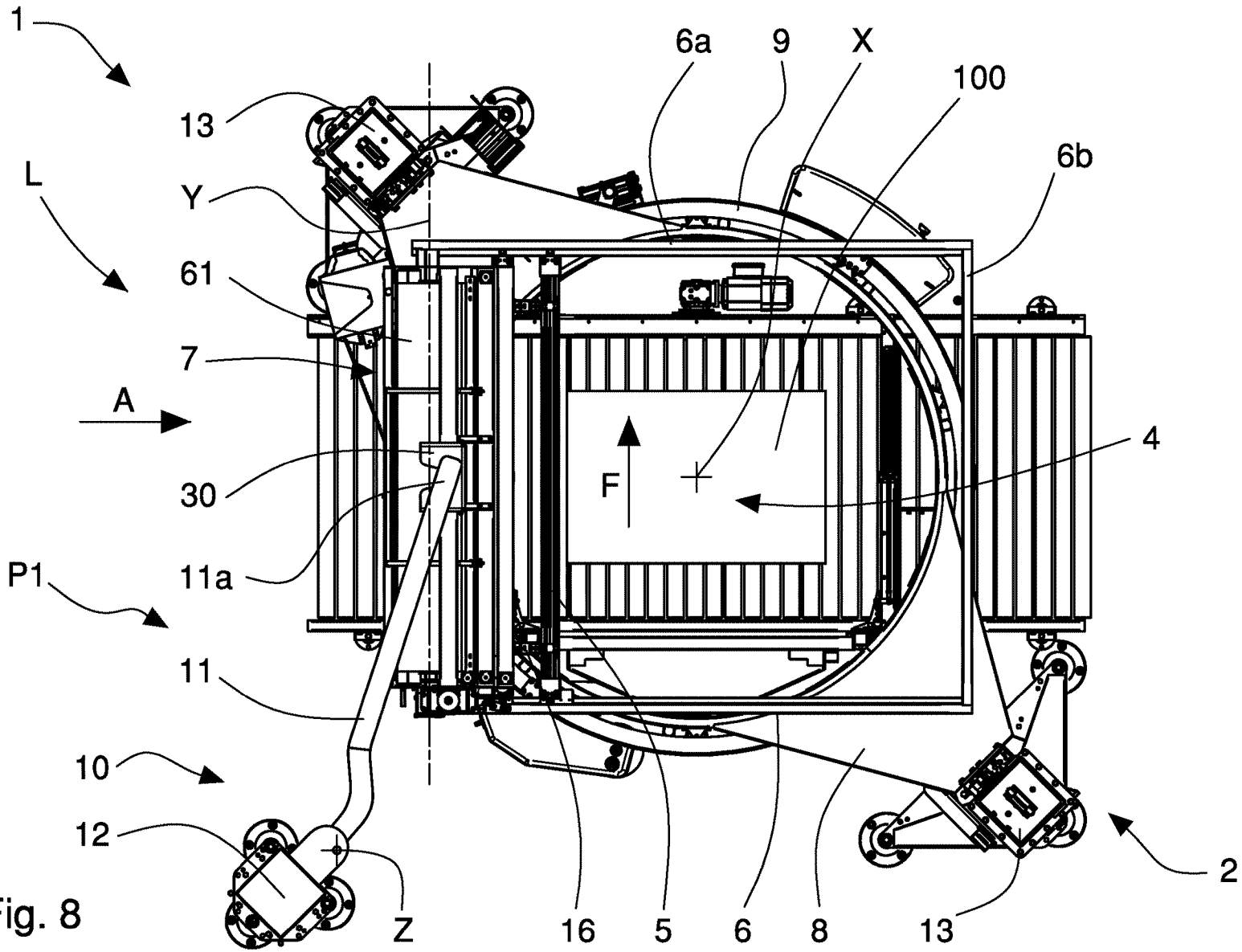
FIG. 8 is a plan view of the wrapping machine of FIG. 7 wherein some parts are removed in order to better illustrate the covering apparatus.
Figure 9:
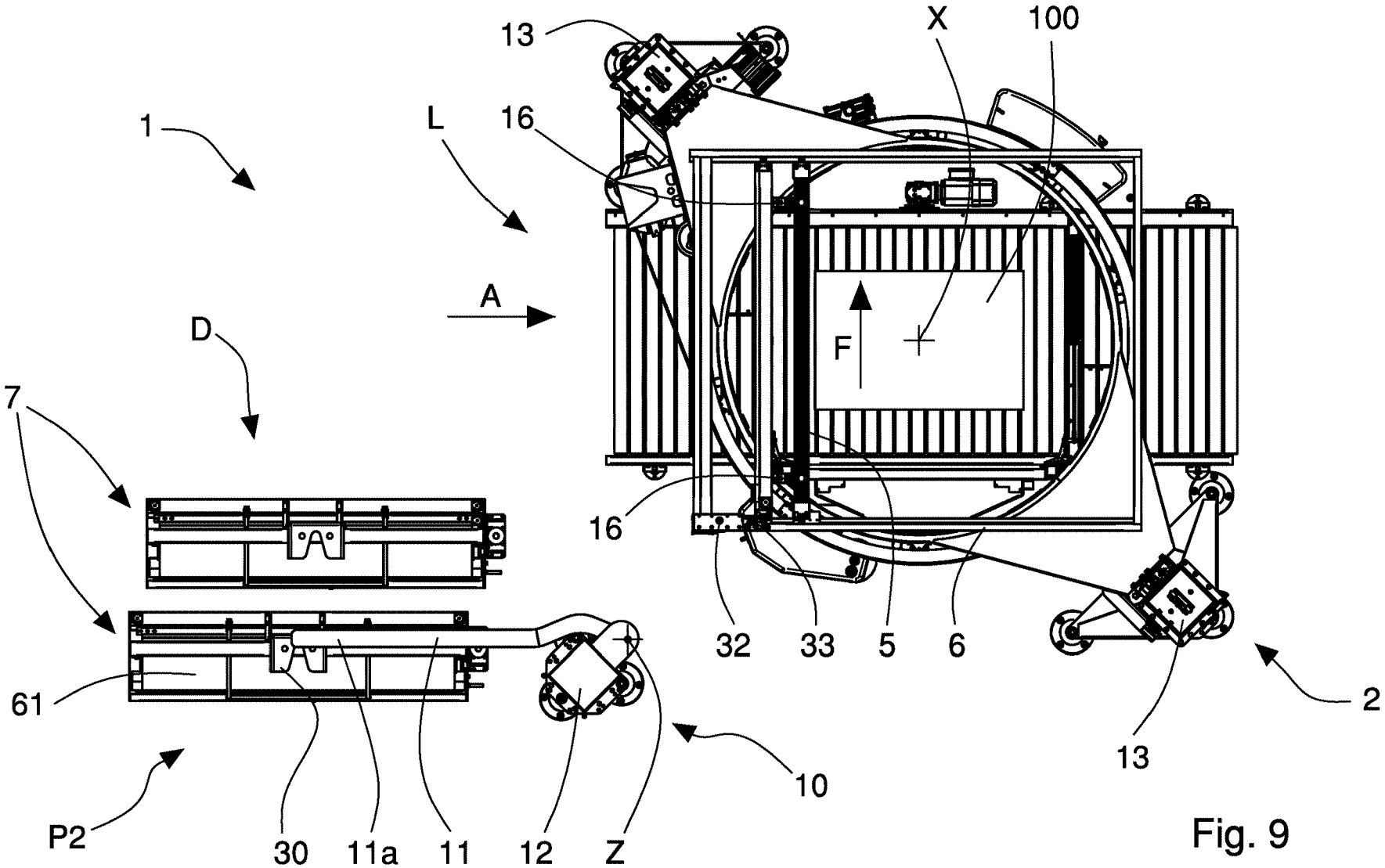
FIG. 9 is a plan view of the wrapping machine of FIG. 7 in a further step of the procedure for replacing the reel of the covering sheet.
Figure 10:
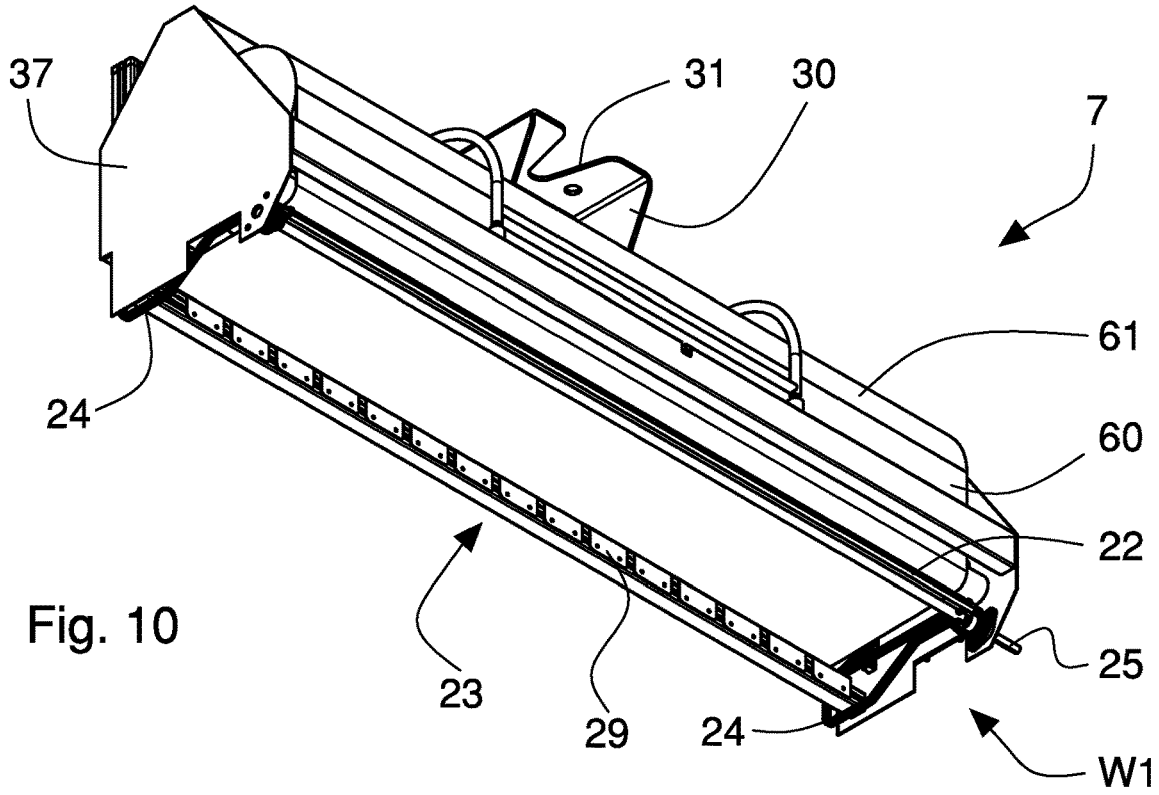
FIG. 10 is an enlarged, perspective view from below of a supplying unit of the covering apparatus.
Figure 11:
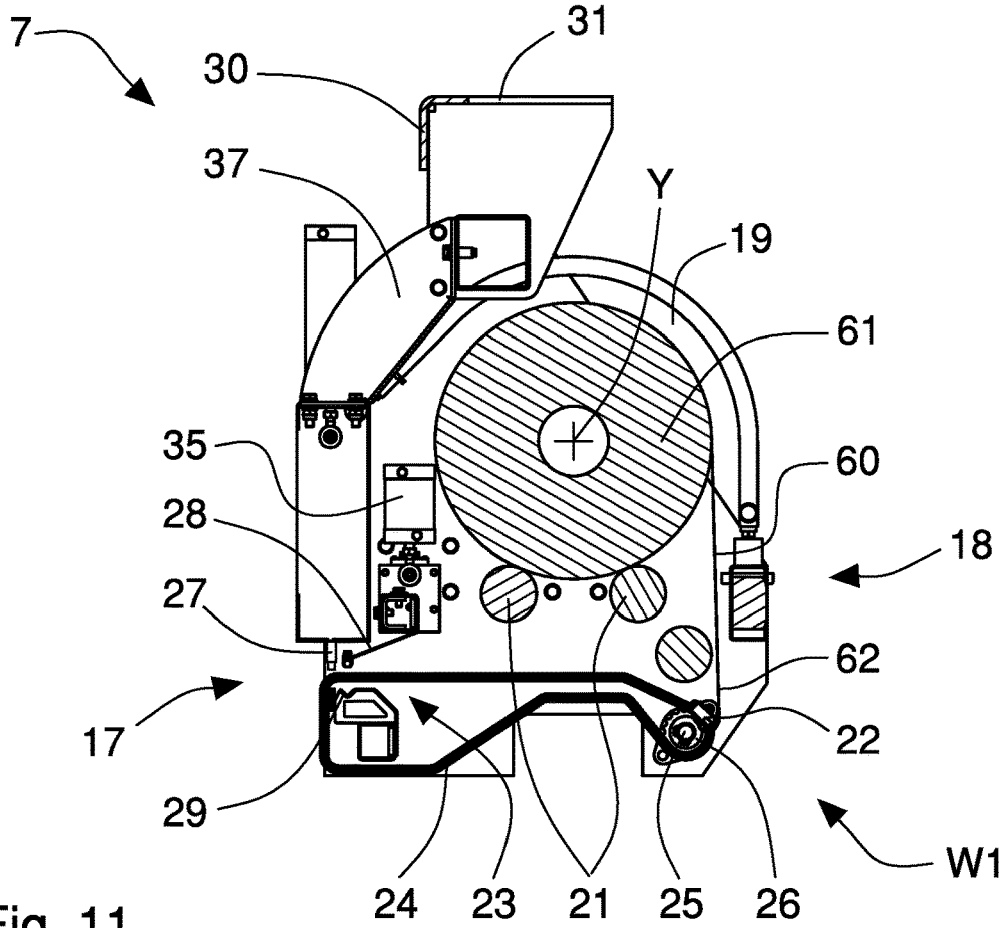
FIGS. 11 to 13 are respective cross sections of the supplying unit of FIG. 10 which illustrate a drawing element of an initial flap of the covering sheet in different positions during a procedure for inserting the sheet.
Figure 13:
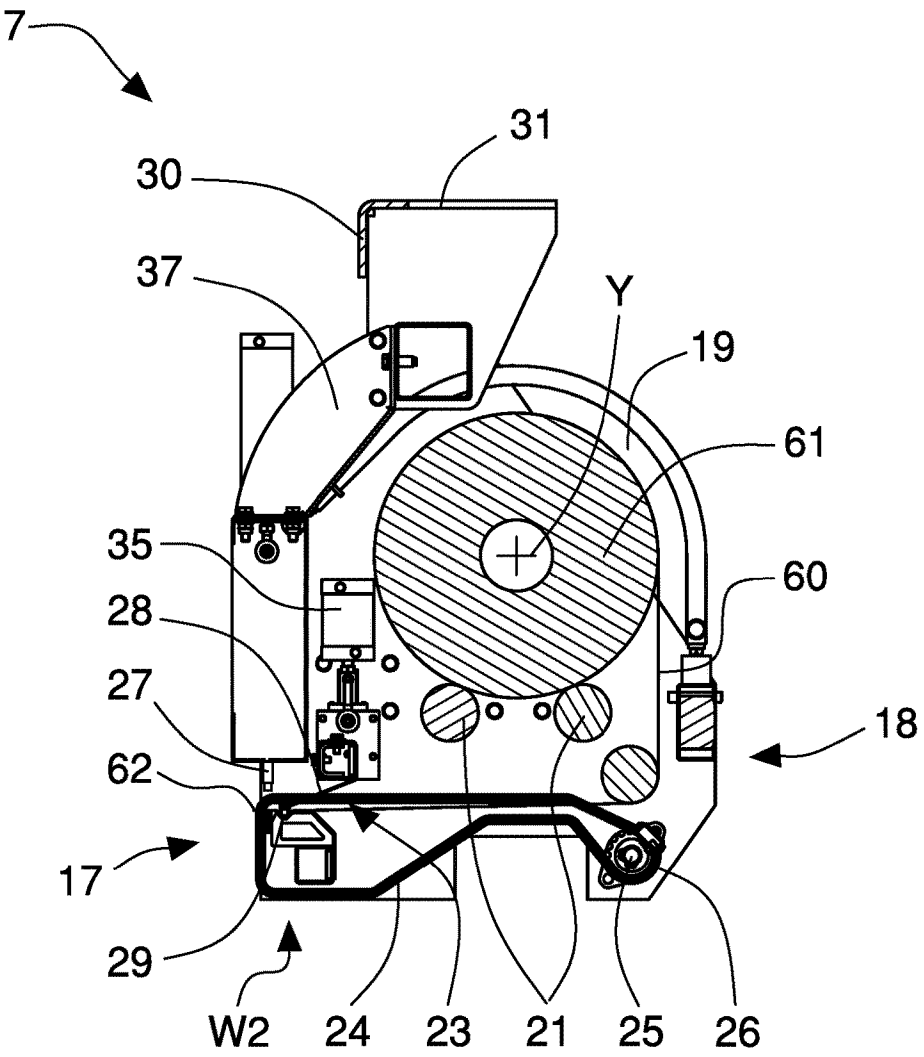
Figure 12:
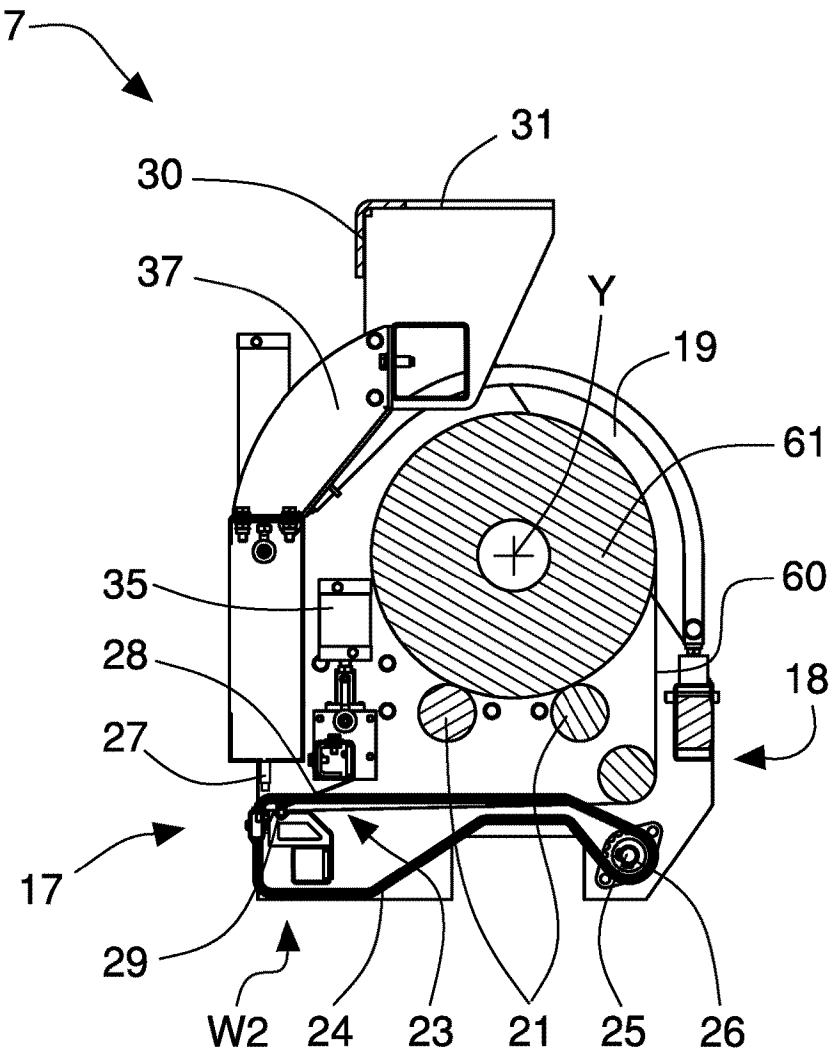

Alternatively, as illustrated in FIGS. 7 to 9, the supporting structure 6 of the covering apparatus 4 of the covering sheet 60 can be fixed to the upper portion of the frame means 2, 8 in a second operating position L, in which the unwinding direction F of the covering sheet 60 is substantially parallel to the advancing direction A, i.e. in which the rotation longitudinal axis Y of the reel 61 is orthogonal to the advancing direction A.

The arrangement of the supporting structure 6 and thus of the covering apparatus 4 in one of the two operating positions T, L can be carried out in a preliminary assembling step of the wrapping machine 1 or in a maintenance and adjusting step, according to the type of load 100 to wrap.

In one variant of the wrapping machine 1 of the invention not illustrated in the figures, the supporting structure 6 is rotatably connected to the upper portion of the frame means 2, 8 such that it can be rotated between the first operating position T and the second operating position L, manually or automatically by proper motor means, such as to allow easy and quick adaptation of the wrapping machine 1 of the invention to the different load formats 100 to be wrapped with the covering sheet 60 and the plastic film 50.

In the embodiment illustrated the wrapping machine 1 of the invention is, for example, a horizontal rotating ring machine and the relative frame means comprise a fixed main frame 2 and a movable frame 8 slidably connected to the main frame 2 and rotatably supporting a rotating ring 9 provided with the wrapping unit 3. The movable frame 8 is particularly movable parallelly to a vertical winding axis X about which the rotating ring 9 rotates. The fixed main frame 2 includes a couple of supporting struts 13 connected at the top by a connecting strut 14.

It is provided that the fixed main frame 2 can comprise three or four supporting struts 13 connected at the top by respective connecting struts.

The supporting structure 6 of the covering apparatus 4 is, for example, fixed to a respective upper portion of the movable frame 8 such as to be moved with the latter parallelly to the winding axis X. Alternatively, the supporting structure 6 can be fixed to an upper portion of the fixed main frame 2.

The wrapping machine 1 of the invention comprises, furthermore, a lifting apparatus 10, positioned adjacent to the covering apparatus 4 and arranged to hook a supplying unit 7 to be mounted on, or dismounted from, the supporting structure 6. The lifting apparatus 10 is movable between a first configuration P1, in which it discharges a supplying unit 7 on, or picks up a supplying unit 7 from, the supporting structure 6, and a second configuration P2 in which the lifting apparatus 10 discharges a supplying unit 7 on, or picks up a supplying unit 7 from, a storage area located adjacent to a wrapping machine 1.

In the embodiment shown in the figures, the lifting apparatus 10 comprises a lifting arm 11 which is slidably and rotatably connected to a supporting column 12 so as to be movable along and about a respective working axis Z, in particular between the first configuration P1 and the second configuration P2. The lifting arm 11 comprises an operating end 11*a* able to hook a supplying unit 7. The supporting column 12 is preferably fixed to the frame means 2, 8 and more precisely to the fixed main frame 2 by means of a respective crossbeam 15 fixed to the upper crossbeam 14 which joins the two supporting struts 13 of the aforesaid fixed main frame 2. The working axis Z is substantially vertical and parallel to the wrapping axis X.

As better explained in the following description, the lifting arm 11 is able to position and mount a supplying unit 7 in the first operating position T or in the second operating position L on the supporting structure 6.

Alternatively, the lifting apparatus 10 can comprise a manipulator, in particular an industrial robot, provided with and operative end adapted to grasp the supplying unit 7.

Figure 6:
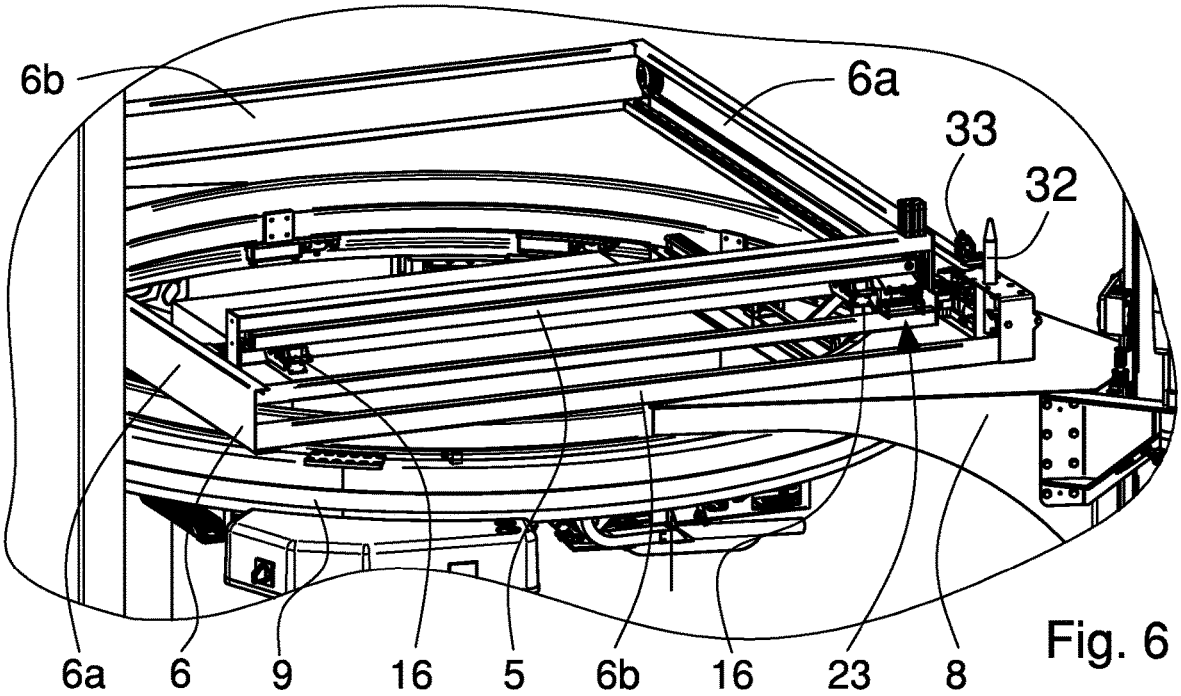
FIG. 6 is an enlarged detail of FIG. 5 illustrating a supporting structure of the covering apparatus.

Referring in particular to FIG. 6, the supporting structure 6 comprises a square-shaped frame consisting in two longitudinal elements 6*a* and two transverse elements 6*b* interconnected to respective ends, the two longitudinal elements 6*a* being arranged to slidably support the gripping means 5. More in detail, the gripping means comprise for example a crossbeam 5 having respective ends slidably engaged with guides, of the known type and not illustrated in detail, associated to longitudinal elements 6*a* of the supporting structure 6. The crossbeam 5 comprises gripping pliers 16, for example two, able to grasp and retain an initial flap 62 of covering sheet 60 supplied by the supplying unit 7. The crossbeam 5 is moved along the unwinding direction F by driving means of the known type and not illustrated such as to unwind from the reel 61 a definite quantity of the covering sheet 60.

A supplying unit 7 can be positioned, removably coupled by means of a reference pin 32 and locking means 33, on a terminal portion of the supporting structure 6.

Referring in particular to FIGS. 10 to 14, the supplying unit 7 comprises roller means 21 for rotatably supporting a reel 61 of covering sheet 60 so that it can rotate about the respective rotation longitudinal axis Y and a drawing element 22 arranged for grasping and retaining an initial flap 62 of the covering sheet 60 and movable almost orthogonally to the rotation longitudinal axis Y between a gripping position W1 and a releasing position W2. Roller means comprise a couple of supporting rollers 21 parallel to the rotation axis Y of the reel 61 and free to rotate about respective longitudinal axis to allow rotation of the reel 61. The drawing element 22 in the gripping position W1 is arranged for receiving and retaining the initial flap 62 of the covering sheet 60 that is unwound from the reel 61, while the drawing element 22 in the releasing position W2, after partially unwinding the covering sheet 60, positions the initial flap 62 at a front portion 17 of the supplying unit 7 from which the covering sheet 60 can come out.

The drawing element 22 has a plurality of hooking elements, of the known type and not illustrated in detail in the figures, which the initial flap 62 of the covering sheet 60 can be fixed to.

The supplying unit 7 also comprises locking means 23 arranged to retain the initial flap 62 moved by the drawing element 22 at the front portion 17, the initial flap 62 being then arranged to be grasped by the gripping means 5.

The locking means 23 comprise in particular at least one first transverse locking element 28 that is movable and actuated by a respective actuator 35, for example a pneumatic cylinder, and at least one respective second transverse locking element 29 fixed to a containment frame 37 of the supplying unit 7. The first transverse locking element 28 is moved by the respective actuator 35 such as to lock the initial flap 62 of the covering sheet 60 against the second transverse locking element 29 in a locking position.

The supplying unit 7 comprises a rear portion 18 that is opposite to the front portion 17 and allows access to a space 19 for housing the reel 61 of covering sheet 60. The space 19 is realized inside the containment frame 37 of the supplying unit 7. The drawing element 22 in the gripping position W1 is positioned at the access rear portion 18 to ease reel-replacement operations performed by a user, as better explained in the following description.

For this purpose, the supplying unit 7 comprises moving means 24 arranged for moving the drawing element 22 between the gripping position W1 and the releasing position W2.

The moving means comprise, for example, a couple of endless flexible elements 24, connected to opposite side walls of the containment frame 37 of the supplying unit 7 and engaged with, and moved by, a driving shaft 25. The drawing element 22 has opposite ends that are fixed to the flexible elements 24 so as to be moved by the latter between the gripping position W1 and releasing position W2. Flexible elements 24 comprise respective belts or tapes or chains rotated by the driving shaft 25 by means of specific pulleys or driving wheels 26. The driving shaft 25 can be rotatably driven to move flexible elements 24, and with them the drawing elements 22, by means of a specific motor, for example electric, installed on the supplying unit 7 or manually by means of a crank.

The supplying unit 7 further comprises cutting means 27, of the known type and not illustrated in detail in the figures, arranged to cut along a direction substantially orthogonal to the unwinding direction F the covering sheet 60 unwound from the reel 61 in order to obtain a portion thereof having a defined length to be applied to the load 100.

The supplying unit 7 is provided with connecting means for electric and/or pneumatic supply and the control of driving actuators and motors which actuate, for example, the moving means 24, locking means 23, cutting means 27.

The supplying unit 7 is also provided with a hooking element 30 arranged to be engaged and locked by an operative end of the lifting apparatus 10. More precisely, the hooking element 30 is fixed to an upper portion of the containment frame 37 of the supplying unit 7 and has a seat 31 arranged to be engaged by the operative end of the lifting apparatus 10.

During operation of the wrapping machine 1 of the invention the covering apparatus 4 supplies portions of established length of the covering sheet 60 which is unwound from the reel 61 by the gripping means 5, slidably supported by the supporting structure 6 and moved by the specific driving means.

The covering apparatus 4 can be mounted on the frame means of the wrapping machine 1, in particular on the movable frame 8 which supports the rotating ring 9, in the first operating position T or in the second operating position L, according to the type of load 100 to wrap. More precisely, in order to best use the covering sheet 60, the covering apparatus 4 is mounted in the first operating position T (in which the unwinding direction F of the covering sheet 60 is substantially orthogonal to the advancing direction A of the load 100), when the wrapping machine 1 is intended to wrap loads having a constant length and equal (slightly lower for allowing a proper covering) to the width of the covering sheet 60 (corresponding to the length of the reel 61).

In case the length of loads 100 to be wrapped changes, it is indeed suitable to mount the covering apparatus 4 in the second operating position L, in which the unwinding direction F of the covering sheet 60 is substantially parallel to the advancing direction A of the load 100, such that the covering sheet 60 can be cut according to the length of the load 100, the width of the covering sheet 60 being adapted to the (maximum) width of the load 100, generally constant.

The covering sheet 60 portions, once cut by the cutting means 27 of the supplying unit 7, fall by gravity on the top of the load 100 onto which they are subsequently locked by the plastic film 50 wound by rotating the wrapping unit 3.

In the case of depletion of the reel 61, the lifting apparatus 10 is actuated to carry out the replacement of the supplying unit 7 mounted on the movable frame 8 and having the depleted reel 61 with an additional supplying unit 7 placed in the storage area D and having a new reel 61. More precisely, in the case of the illustrated embodiment, the lifting arm 11 is moved in the first configuration P1, in which it is able to hook the supplying unit 7 with depleted reel 61.

The lifting arm 11 is therefore moved, in particular lifted, such as to detach and pick up the supplying unit 7 from the supporting structure 6 and store the supplying unit 7 in the storage area D, arranging in the second configuration P2. To allow the detachment of the supplying unit 7, the locking means 33 mounted on the supporting structure 6 are priorily deactivated. The lifting arm 11 discharges into the storage area D the supplying unit 7 with depleted reel 61 and hooks an additional supplying unit 7 with a new reel 61. Subsequently, the lifting arm 11 is lifted and returned in the first configuration P1 such as to mount on the supporting structure 6 the additional supplying unit 7 with a new reel 61 and allow production to restart. It must be noted that the procedure for replacing the supplying unit 7, i.e. the reel 61 of the covering sheet 60, can be carried out completely automatically controlling specifically the lifting apparatus 10. For this purpose, one or more replacement supplying units 7, provided with new reels 61 can be prearranged in specific and known positions of the storage area D, wherein they can be picked up from the lifting apparatus 10. The supplying units 7 dismounted from the wrapping machine can instead be positioned in additional positions in the storage area D as they contain depleted reels of covering sheet.

It must be also noted that the procedure for replacing the supplying units 7 can be equally carried out rapidly and easily with the covering apparatus 4 mounted on the frame means 2, 8 of the wrapping machine 1 in the first operating position T or in the second operating position L. The lifting arm 11 can in fact rotate about the working axis Z, such as to pick up/position the supplying unit 7 from/onto the supporting structure 6 in both the operating positions T, L. The operating end 11*a* of the lifting arm 11 is in fact able to hook the supplying unit 7 regardless of its position/orientation on the frame means 2, 8.

Referring in particular to FIGS. 10 to 13, the supplying unit 7 can be prearranged on the floor by the operator such as to allow the automatic operation of the wrapping machine 1 when it is mounted by the lifting apparatus 10 on the supporting structure 6. More precisely, after removing a depleted reel 61 from the space 19 of the supplying unit 7 and inserting a new reel laying it on the supporting rollers 21, the user grasps the initial flap 62 of the covering sheet 60 unwound from the reel 61 and inserts it, locking it, into the hooking elements of the drawing element 22. The latter is arranged in the gripping position W1, at the rear portion 18 of the supplying unit from which the space 19 of the reel 61 is accessed. Thereby, it is rapid and easy for the user both inserting the reel 61 into the space 19 and fixing the initial flap 62 to the drawing element 22.

At this time, the moving means 24 are actuated such as to move the drawing element 22 into the releasing position W2. In particular, flexible elements 24 supporting the drawing element 22 are actuated rotating the driving shaft 25 manually by means of a crank or actuating a proper motor installed on the supplying unit 7.

In the first case, it is the user standing on the ground, in the storage area D, the one who moves the crank to position the initial flap 62 of the covering sheet 60 at the front portion 17 of the supplying unit 7 before the latter is mounted on the wrapping machine 1. In the second case, the electric motor actuating the moving means 24 is connected to a power supply and to a control unit of the wrapping machine 1 when the supplying unit 7 is mounted on the supporting structure 6 and locked there by the locking means 33.

Once connected, the electric motor is actuated such as to move the drawing element 22 into the releasing position W2 and the initial flap 62 of the covering sheet 60 at the front portion 17 of the supplying unit 7.

When the initial flap 62 of the covering sheet 60 is at the front portion 17, the gripping means 23 are actuated. More precisely, the first transverse locking element 28 is moved by the respective actuator 35 such as to force and lock the initial flap 62 against the respective second transverse locking element 29 in the locking position. At this time the drawing element 22 can be returned into the gripping position W1, the hooking elements of the aforesaid drawing element 22 disengaging from the initial flap 62 tightly held by the gripping element.

With the initial flap 62 locked by the gripping means 23 and arranged at the front portion 17 of the supplying unit 7, the gripping means 5 of the covering apparatus 4 are actuated such as to grasp, by means of the gripping pliers 16, the aforesaid initial flap 62. The gripping means 23 can at this time be actuated such as to release the initial flap 62.

The gripping means 5, moved along the guides of the longitudinal elements 6*a* of the supporting structure, are able to unwind the covering sheet 60 from the reel 61 and arrange it over the load 100. By actuating the cutting means 27, the covering sheet 60 is cut and a predefined-length portion thereof falls by gravity on the load 100.

Before cutting, the locking means 23 are actuated such as to retain the initial flap 62 generated by cutting the covering sheet 60, the supplying unit 7 being able again to supply the gripping means 5 with the covering sheet for a subsequent load 100.

Due to the covering apparatus 4 comprising the supporting structure 6, fixed to the frame means 2, 8 of the wrapping machine 1, and the supplying unit 7 reversibly coupled to the supporting structure 6, the wrapping machine 1 of the invention allows an easy and rapid replacement of the reel 61 of the covering sheet 60. It is in fact not necessary for the user to get to the top of the wrapping machine 1 to replace the depleted reel 61, as the entire supplying unit 7 can be easily mounted/dismounted, particularly using the lifting apparatus 10, onto/from the movable frame 8 of the wrapping machine 1. Moreover, the reel 61 of the covering sheet 60 can be easily and quickly removed from or inserted in the supplying unit 7 when the latter is positioned on the floor, in the storage area D. It is similarly possible for the user to easily and quickly prepare the initial flap 62 of the covering sheet 60 so as to be grasped by the gripping means 5 of the supporting structure 6 which can thus unwind above the load a portion of proper length of the covering sheet 60. The aforesaid operations can be performed easily and safely by the user standing on the floor at a safety distance from the wrapping machine, thus reducing significantly the stop time of the wrapping machine and the risks for the user safety.

The invention claimed is:

1. A wrapping machine comprising:

a frame for supporting a wrapping unit arranged to wrap a load with a film of plastic material;

a lifting apparatus; and a covering apparatus that is arranged to supply a covering sheet to be positioned on top of the load, the covering apparatus comprising:

a supporting structure that is connected to an upper portion of said frame;

a supplying unit that supports a reel of the covering sheet and that is reversibly coupled to said supporting structure so as to be removable and replaceable with another supplying unit; and a gripping assembly movable along an unwinding direction and arranged to grasp and unwind the covering sheet from the reel and arrange the covering sheet above the load, wherein said supporting structure slidably supports said gripping assembly, said lifting apparatus is positioned adjacent to said covering apparatus and is arranged to hook said supplying unit to be mounted to, or dismounted from, said supporting structure, and said supplying unit comprises a hooking element arranged to be engaged and locked by an operating end of said lifting apparatus.

2. The wrapping machine according to claim 1, wherein said supporting structure is fixed to said upper portion of said frame in a first operating position, in which the unwinding direction is transverse to an advancing direction of the load through said wrapping machine, or in a second operating position, in which the unwinding direction is parallel to the advancing direction.

3. The wrapping machine according to claim 1, wherein said frame comprises a fixed main frame and a movable frame, wherein said movable frame is slidably connected to said fixed main frame and rotatably supports a rotating ring provided with said wrapping unit, and wherein said supporting structure of said covering apparatus is fixed to a respective upper portion of said fixed main frame or to a respective upper portion of said movable frame.

4. The wrapping machine according to claim 2, wherein said supporting structure is rotatably connected to said upper portion of said frame so as to be rotatable between the first operating position and the second operating position.

5. The wrapping machine according to claim 1, wherein said lifting apparatus comprises a lifting arm slidably and rotatably connected to a supporting column and fixed to said frame so as to be movable along and about a first axis, wherein said lifting arm comprises said operating end configured to grasp said supplying unit.

6. The wrapping machine according to claim 1, wherein said lifting apparatus comprises a manipulator provided with said operating end configured to grasp said supplying unit.

7. The wrapping machine according to claim 1, wherein said supplying unit further comprises:

rollers for rotatably supporting the reel of the covering sheet so that the reel can rotate about a rotation longitudinal axis;

a drawing element movable orthogonally to the rotation longitudinal axis, between a gripping position, in which said drawing element is arranged to receive and retain an initial flap of the covering sheet unwound from the reel, and a releasing position, in which said drawing element, after having partially unwound the covering sheet, positions the initial flap at a front portion of said supplying unit from which the covering sheet comes out; and a locking assembly for retaining the initial flap moved by said drawing element at said front portion of said supplying unit, wherein the initial flap is then arranged to be grasped by said gripping assembly.

8. The wrapping machine according to claim 7, wherein said supplying unit further comprises a rear portion to access a containment space of the reel of the covering sheet, and wherein said drawing element in the gripping position is positioned at said rear portion.

9. The wrapping machine according to claim 7, wherein said supplying unit further comprises a moving system for moving said drawing element between the gripping position and the releasing position.

10. The wrapping machine according to claim 9, wherein said moving system comprises a plurality of endless flexible elements that are connected to opposite side walls of said supplying unit and that are engaged with and moved by a driving shaft, and wherein said drawing element has opposite ends that are fixed to said endless flexible elements.

11. The wrapping machine according to claim 10, wherein said driving shaft is rotatable in order to move said endless flexible elements and said drawing element by a motor or manually by a crank.

12. The wrapping machine according to claim 1, wherein said supplying unit further comprises a cutting element arranged to cut the covering sheet unwound from the reel along a direction orthogonal to the unwinding direction in order to have a portion of the covering sheet with a defined length to be positioned on the load.

13. The wrapping machine according to claim 1, wherein said lifting apparatus is movable between a first configuration, in which said lifting apparatus discharges a supplying unit on, or picks up a supplying unit from, said supporting structure, and a second configuration, in which said lifting apparatus discharges a supplying unit on, or picks up a supplying unit from, a storage area located adjacent to said wrapping machine.

* * * * *